United States Patent [19]

Morgan

[11] Patent Number: 4,900,036

[45] Date of Patent: Feb. 13, 1990

[54] CURVED FRONTBOARD GAME

[76] Inventor: Richard H. Morgan, 134 S. Gain St., Anaheim, Calif. 92804

[21] Appl. No.: 303,300

[22] Filed: Jan. 30, 1989

[51] Int. Cl.[4] ..... A63B 63/04

[52] U.S. Cl. ..... 273/402

[58] Field of Search ..... 273/1.5 R, 1.5 A, 398–402, 273/407, 329

[56] References Cited

U.S. PATENT DOCUMENTS

| | | | |
|---|---|---|---|
| 430,155 | 6/1890 | Taylor | 273/329 X |
| 507,098 | 10/1893 | Bates | 273/401 |
| 574,087 | 12/1896 | Frick | 273/402 |
| 1,541,980 | 6/1925 | Luber | 273/401 |
| 2,021,989 | 11/1935 | De Master | 273/105 |
| 2,039,794 | 5/1936 | Hayden | 273/1.5 |
| 2,194,786 | 3/1940 | Chervenka et al. | 273/1.5 R |
| 2,545,615 | 3/1951 | Hatley | 273/105 |
| 2,570,860 | 10/1951 | Redding | 273/329 |
| 2,647,747 | 8/1953 | Kenney et al. | 273/95 |
| 2,932,516 | 4/1960 | Penner | 273/105 |
| 3,244,420 | 4/1966 | Poynter | 273/1.5 |
| 3,421,764 | 1/1969 | Smith et al. | 273/402 |
| 3,910,575 | 10/1975 | Miller | 273/1.5 A |
| 4,316,613 | 2/1982 | Harris | 273/401 |
| 4,717,150 | 1/1988 | Prisnow | 273/1.5 R |

*Primary Examiner*—Paul E. Shapiro

[57] ABSTRACT

Apparatus for a game somewhat similar to basketball, in which target holes are cut in a curved frontboard which encloses the three open sides of a basketball hoop. Mounting structure is described permitting the three target holes to be just below or just above the existing basketball hoop, at the option of the player. The entire apparatus is mounted on, and clamped to, an existing basketball hoop.

6 Claims, 2 Drawing Sheets

CURVED FRONTBOARD GAME

BACKGROUND OF THE INVENTION

1. Field of the invention

The invention consists of apparatus for a court game similar in some respects to basketball, but having the target at which the ball is thrown lying in a vertical plane, and having a curved "backboard" which disperses missed shots over a wide area.

2. Description of Prior Art

The idea of throwing a ball through a vertical aperture, as distinct from causing it to land in a horizontal aperture as in basketball, makes for an interesting game. Frick (U.S. Pat. No. 574,087) patented a lawn game based on this idea in 1896. Although the structure of his apparatus differed markedly from my invention, it being flat and held at or below eye level by stakes, the possibility of an exciting game was recognized. Penner (U.S. Pat. No. 2,932,516) used a volleyball and a height-adjustable single target aperture mounted on a flat plate adjustable in height at or near eye level. Morgan (U.S. Pat. No. 613,383) and Hatley (U.S. Pat. No. 2,545,615) used only a ring as the target, omitting the backboard. Kenney, et. al. (U.S. Pat. No. 2,647,747) improved the difficulty and so the excitement by mounting his football target well above eye level on a basketball hoop. Hatley's apparatus was also elevated, located in the center of the playing field, and six-sided.

All these variations on ball-throwing into an aperture located in a vertical plane tested the skill and agility of the players or teams, this testing being what made the game exciting. My invention introduces a new factor, penalizing lack of skill and rewarding skill to an appropriate degree for a game which is basically a contest.

SUMMARY OF THE INVENTION

Considering the backboard behind a basket hoop as closing one side, my invention is a frontboard which curves around the three remaining sides of the basket hoop. The frontboard extends either downward from just above the hoop, or may be positioned to extend upward from just below the hoop. The distance it extends is sufficient to allow target holes, preferably three circular holes, one in each direction, centered vertically in the frontboard. Above and below the holes there is a full arc of uninterrupted frontboard roughly ½ the hole size in height. Typically, a seven inch ball would be used with a front hole twelve inches in diameter and side holes ten inches. The object of the game is to toss the ball through the holes, which may be mounted so as to be above or below the basket hoop. The hoop plays no part other than supporting the frontboard and establishing its height from the ground.

In a variation of the basic design, a vertical slot may be added between the holes and the lower edge of the frontboard. The addition of this slot allows a ball equipped with an attached cord, elastic or inelastic, to be used for a solitary game or for practice.

The structural mounting must not obstruct passage of a ball downward and through the hoop, when the frontboard is installed so the frontboard holes are above the basket hoop. Other than that, various mountings may be used, preferably ones that allow the frontboard assembly to rest on the basket hoop during installation and removal so the necessary clamping means securing the frontboard to the basket hoop can be easily installed.

DETAILED DESCRIPTION OF THE PREFERRED EMBODIMENT

In the following description, use is made of the terms forward, side, horizontal, and above, the viewpoint is that of an observer standing at the free-throw position in the game of basketball, the forward direction being closer to the observer. Horizontal and vertical are loosely defined as being in planes parallel to the basket hoop and backboard, respectively.

In the preferred embodiment, the frontboard, Item 1, may be visualized as a flat rectangle of thin material such as plastic, with its long side bent so as to be convex from the front, and containing three holes larger than the ball to be used. The holes are centered on the short side of the rectangle, and positioned so as to eventually be on the front and sides of the convex arcuate (the bent) frontboard. The frontboard is not bent into an arc of a circle, rather it passes closer to the front of the basket hoop than it does to the sides, as shown in FIGS. 2 and 5.

In playing the game the curved nature of the frontboard is important. If one measures the angle at which a ball striking a surface rebounds relative to a normal at the point of contact, the striking angle and the rebounding angle are equal. However, from the players point of view, the rebound angle is to be measured from the line from player to point of contact. A rebound angle thus defined is important to the player because it defines how far away from him the rebounding ball passes, which determines whether he can seize the ball and make another try at scoring a hit. Obviously, then, when a ball is striking a convex arcuate surface, it requires more precise thrown-direction to keep the rebound angle within the player's capacity than when the ball is striking a flat surface. Hence, the curvature increases the importance of skill.

Figure 1:
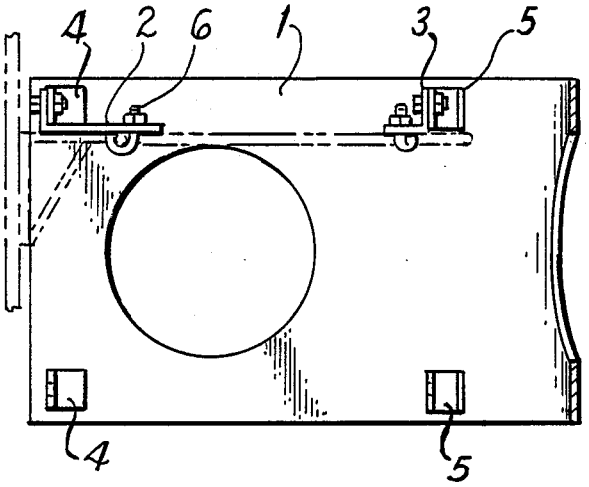
FIG. 1 is a side view of the preferred embodiment, seen with the near half removed.
Figure 4:
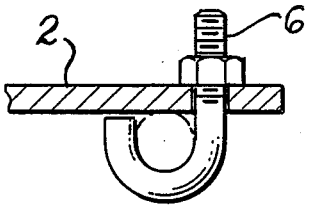
FIG. 4 is a detail showing the means for clamping the invention to the existing basket hoop.
Figure 2:
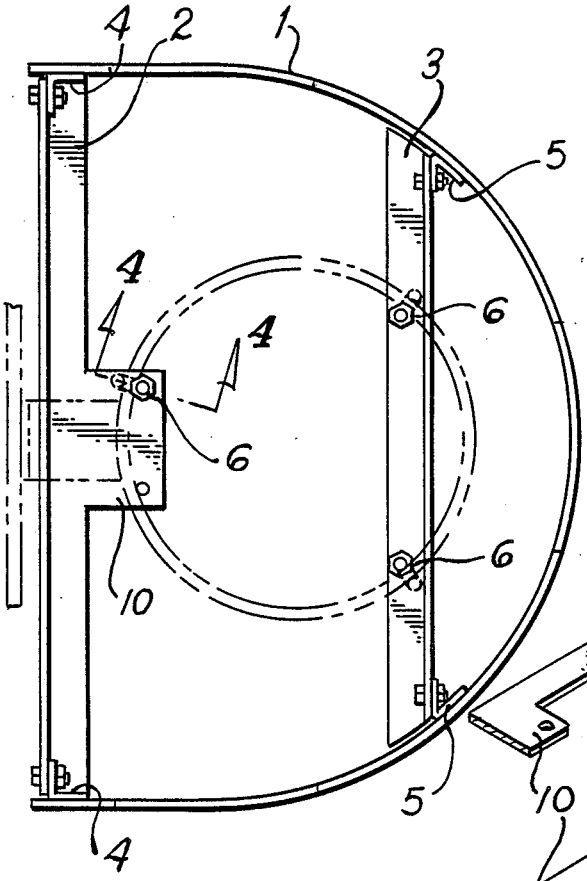
FIG. 2 is a top view of the preferred embodiment.
Figure 3:
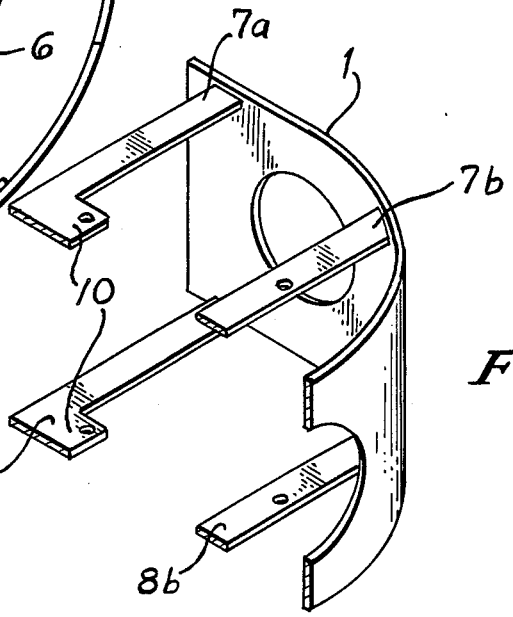
FIG. 3 is a perspective view of an alternate embodiment, the near half being cut away.

FIGS. 1 and 2 show a first supporting member 2 and a second supporting member 3 extending transversely from side to side of the convex arcuate frontboard 1. The ends of 2 and 3 may be attached to the upper set of brackets 4 and 5 respectively, or to the lower set, as best seen in FIG. 1. As either the upper or the lower position uses four brackets, the set of brackets in use is referred to as a "four," analogous to a pair. Supporting members 2 and 3 rest on top of the basket hoop, and contain provision for clamping to the basket using hook means 6 as shown in FIG. 4. In order to have first supporting member 2 positioned close to the backboard and close to the free ends of convex arcuate frontboard 1, a central portion thereof (Item 10) may protrude horizontally forward far enough to reach the basket hoop, which is normally four or five inches from the backboard. This portion 10 is shown in FIGS. 1, 2, and 3. Only one hook means 6 engages first supporting member 2. Second supporting member 3 has two hook means 6 since it crosses the circular basket hoop in two places. Item 3 rests on the basket hoop short of the front, hence passes chordwise across the circular hoop. The hook means includes a bent portion, a straight portion which is threaded, and a nut. It is used to clamp the supporting members to the basket hoop. Bracket means 4 and 5, which include bolts or pins or the like, are shown in FIGS. 1, 2, and 5 are permanently fastened to convex arcuate frontboard 1. This is the preferred embodiment.

Figure 5:
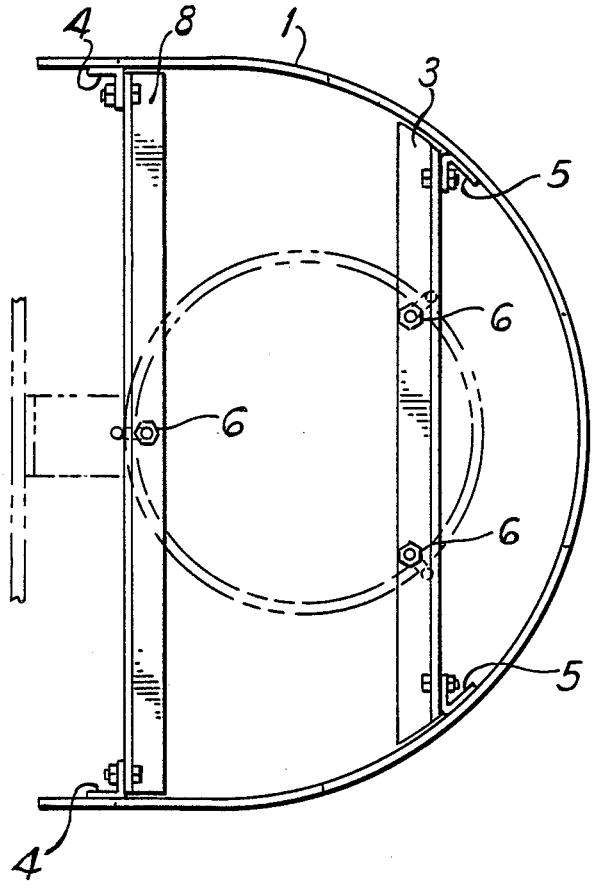
FIG. 5 is a top view of an alternate mounting means without a protruding portion on the transverse first mounting member.
Figure 6:
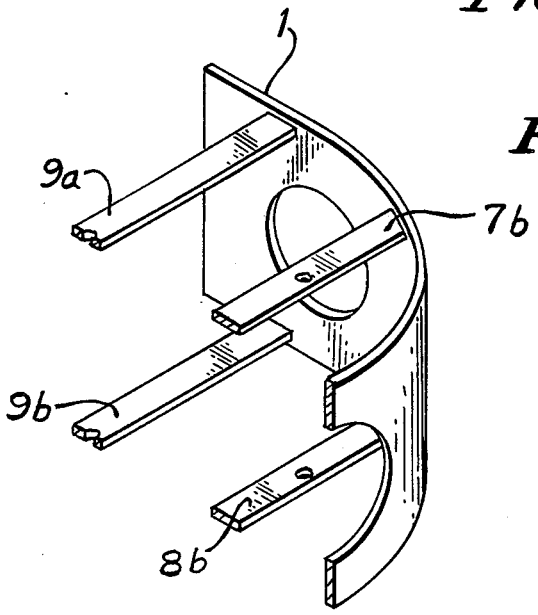
FIG. 6 is a perspective cutaway view showing another mounting means.

Three alternate structures for supporting the frontboard are shown in FIGS. 3, 5, and 6. In the construction shown in FIGS. 3 and 6, four supporting members are permanently part of, or fixed to, convex arcuate frontboard 1. The alternate first supporting members are Items *7a* and *8a*. The alternate second supporting members are Items *7b* and *8b*. The resulting assembly may be rested on the basket hoop using either *7a* and *7b* or *8a* and *8b*, and fastened to the hoop with hook means 6.

FIGS. 5 and 6 show two supporting means similar in all but one respect to those already described. The one change is the elimination of the protrusion 10 on first supporting member 2, *7a*, or *8a*, and moving the supporting member forward enough to fasten it directly to the basket hoop using Item 6 hook means. The alternate first supporting member is Item 8 in FIG. 5 and Items *9a* or *9b* in FIG. 6.

Figure 7:
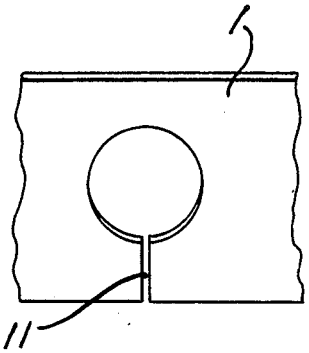
FIG. 7 is a perspective view showing a slotted hole.

FIG. 7 shows a variation in the configuration of the target holes in frontboard 1. Should it be desired to have a cord attached to the ball, either for practice or to make a solitary game of it, slot 11 may be incorporated, through the frontboard and running from one or more holes to the lower edge of frontboard 1. The purpose of slot 11 is to permit the player to recover the ball. Obviously, the cord can be elastic or inelastic; and when the game is played in this manner, the mounting must use the upper mounting members or upper set of brackets to prevent the cord from hanging up on the basket hoop.

The invention having been described in its preferred embodiment, it is clear that modifications are within the ability of those skilled in the art without exercise of the inventive faculty. Accordingly, the scope of the invention is defined in the scope of the following claims:

I claim:

1. Apparatus for a game to be played with a spherical ball, the apparatus being attached to a conventional basket hoop as used in basketball and having a backboard, comprising:

a convex arcuate frontboard having a multiplicity of holes extending from the backboard on one side of the basket hoop, around the front of the basket hoop, and back to the backboard on the other side of the basket hoop, said holes being located on the sides and front of said frontboard and of a size larger than the basketball, whereby the rebound angle of a ball not striking said frontboard squarely is larger, due to the curvature of said frontboard, than the rebound angle of a flat backboard.

2. Apparatus as in claim 1, further comprising:

a first supporting member extending horizontally from end to end of said convex arcuate frontboard and having a portion protruding horizontally forward in its center, and a second supporting member similarly extending from side to side of said convex arcuate, spaced from the protruding portion of said first supporting member a distance less than the diamter of the basket hoop such that said second supporting member passes chordwise across the front of the basket hoop, and hook means for attaching the protruding portion of said first supporting member and said second supporting member to the basket hoop, and at least two fours of bracket means for attaching said convex arcuate frontboard to the four ends of said first and second supporting members, each four of bracket means being fixed to said convex arcuate frontboard in a plane perpendicular to said frontboard but at a singular elevation, whereby, the elevation of said frontboard relative to the basket hoop can be controlled by which four of bracket means is used.

3. Apparatus as in claim 1, further comprising:

two first supporting members extending horizontally from end to end of said convex arcuate frontboard and having a portion protruding horizontally in their center, the two members being fixed at their ends to said frontboard directly above one another and nearer the edge of said frontboard than said holes, and two second supporting members similarly extending from side to side of said convex arcuate frontboard, in the same horizontal planes as said first supporting members, spaced a distance from the protruding portion of said first supporting members less than the diameter of the basket hoop such that said second supporting member passes chordwise across the front of the basket hoop and hook means for attaching the protruding portion of said first supporting members and said second supporting members to the basket hoop, whereby the elevation of said frontboard relative to the basket hoop can be controlled by selecting which first and second supporting members will be attached to the basket hoop.

4. Apparatus as in claim 1, further comprising:

a first supporting member extending from side to side of said convex arcuate frontboard and a second supporting member shorter than said first supporting member, also extending from side to side of said convex arcuate frontboard, and sets of four bracket means fixed to the inner surface of said convex arcuate frontboard and to which the ends of said first and second supporting members may be attached, each said set being in a single horizontal plane, positioning said first supporting members such distance from the ends of said convex arcuate frontboard that it may pass above the basket hoop at one point, and positioning said second supporting member parallel to said first supporting member at a distance smaller than the diameter of the basket hoop so said second member passes chordwise across the front of the basket hoop, one said set being above said holes in said convex arcuate frontboard and one being below said holes, and hook means for clamping said first and second supporting members to the basket hoop at points where they rest on the basket hoop.

5. Apparatus as defined in claim 1, further comprising:

a first set of first and second supporting members extending in the same plane between the sides of and fixed to said convex arcuate frontboard at an elevation above said holes therein and at a fore-aft position with respect to the ends of said frontboard such that both said members may rest on the basket hoop at at least one point, the first supporting member being closer to the backboard, and a second set of first and second supporting members extending in the same plane between the sides of and fixed to said convex arcuate frontboard at an elevation below said holes therein, said second set being directly below said first set, and hook means for clamping said first and second supporting members to the basket hoop.

6. Apparatus as described in claim 1, further comprising:

a slot connecting the holes in said frontboard to the lower edge of said frontboard, said slot being entirely through said frontboard.

* * * * *